United States Patent [19]

Botvin

[11] 4,098,405

[45] Jul. 4, 1978

[54] MESH CONTAINER AND HEADER

[75] Inventor: George Botvin, Cumberland, R.I.

[73] Assignee: A.C.S. Industries, Inc., Woonsocket, R.I.

[21] Appl. No.: 802,045

[22] Filed: May 31, 1977

[51] Int. Cl.[2] ..... B65D 29/00; B65D 33/06

[52] U.S. Cl. ..... 206/527; 229/62

[58] Field of Search ..... 206/525, 527, 315 B, 206/806, 286, 289, 45.34, 164; 229/62, 52 A, 53; 223/87; 248/311.1; 220/90

[56] References Cited

U.S. PATENT DOCUMENTS

| | | | |
|---|---|---|---|
| 1,872,640 | 8/1932 | Pink | 206/315 B |
| 2,951,615 | 9/1960 | Crane | 229/52 A |
| 2,997,169 | 8/1961 | Poupitch | 206/164 |
| 3,040,966 | 6/1962 | Crane | 229/53 |
| 3,085,725 | 4/1963 | Caparosa | 206/806 |
| 3,132,742 | 5/1964 | Shapiro et al. | 206/45.34 |
| 3,661,351 | 5/1972 | Olsen | 248/311.1 |
| 3,837,544 | 9/1974 | Greenwald | 223/87 |

*Primary Examiner*—William T. Dixson, Jr.

*Attorney, Agent, or Firm*—Hopgood, Calimafde, Kalil, Blaustein & Lieberman

[57] ABSTRACT

A container includes a mesh package and a header which serves both to close the upper end of the package and to provide a convenient handle for the package. The header is secured to the package without the use of fasteners or adhesives by the provision of wing members at the lower end of the header which are shaped and dimensioned so as to project through mesh openings in the package when the lower end of the header is inserted into the upper end of the package.

3 Claims, 2 Drawing Figures

MESH CONTAINER AND HEADER

The present invention relates generally to packaging and, more particularly, to an arrangement for providing a header with a package made of a mesh material.

The use of packages containing a header or insert on which product information and advertising material may be printed is, of course, known, as is the use of a mesh material to form the package or container. Mesh packages are particularly desirable as they permit the customer to see the articles in the packages before she makes her purchase. Headers are typically attached to mesh packages by the use of fasteners, such as staples, or an adhesive. In the known packages, the upper and lower ends of the mesh package are closed and the header is then attached to the closed upper end of the container by the fasteners or by the adhesive.

The need to close both ends of the mesh container before attaching the header, and the additional need to attach the header to the closed container with a fastener or adhesive, increase the cost of manufacturing the package both as to the costs of labor and materials. Since the articles sold in such packages are usually low-cost articles, the cost of the packaging is significant in the final price of the articles; that is, even a relatively small decrease in the packaging cost may result in a significant reduction in the cost of the articles.

It is, therefore, an object of the invention to provide a package including a header which is easier and less costly to assemble.

In accordance with the invention, there is provided a package and header arrangement in which the package is made of a mesh material containing openings through which the packaged articles can be viewed by the purchaser. Unlike prior arrangements, the package is closed only at its lower end, and the open end receives the lower end of the header. The latter includes a pair of opposed winglike tapering portions which, when the header is inserted into the open end of the mesh package, project through openings in the mesh package. The projection of the winglike members serves to reliably secure the header to the package, while at the same time closing the upper end of the package.

To the accomplishment of the foregoing and to such further objects as may hereinafter appear, the present invention relates to a package and header arrangement substantially as defined in the appended claims, and as described in the following specification as considered with the accompanying drawing in which:

Figure 1:
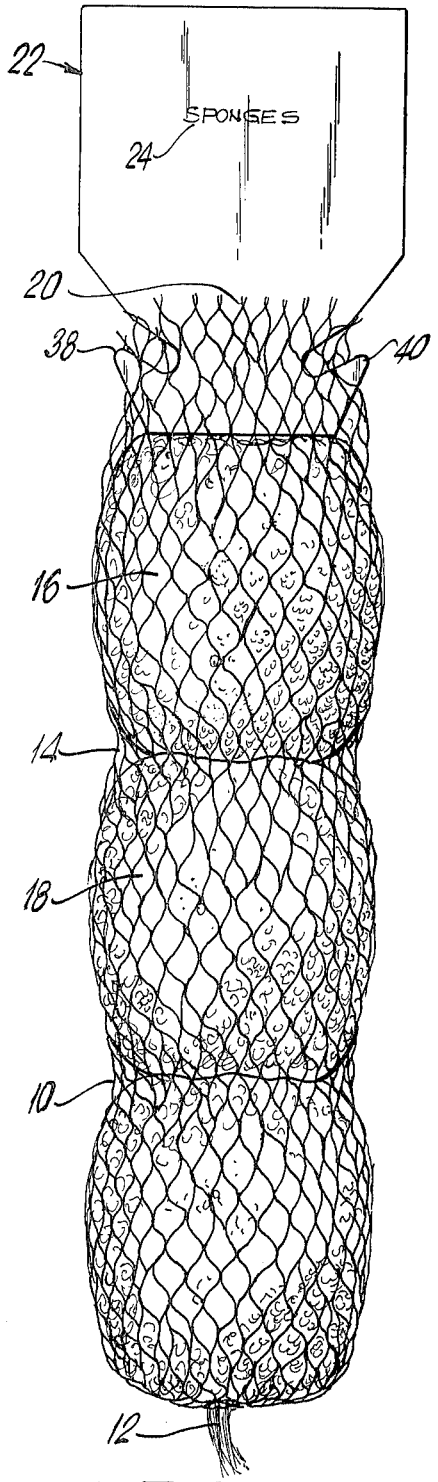
FIG. 1 is an elevation of the package of the invention.

Referring to the figures, the container of the invention comprises a mesh package 10 closed at its lower end 12 in a conventional manner, by tying together the ends of the individual filaments or strings 14 from which the package 10 is formed. The filaments, which may be of plastic, string, or a similar material, are connected to one another at spaced points of attachment to form a plurality of openings or meshes 16, through which the articles 18, which may typically be sponges or similarly shaped products, contained in the package may be viewed by the purchaser. As is conventional, the mesh package can be expanded to some extent to accommodate itself to the size and shape of the articles.

Figure 2:
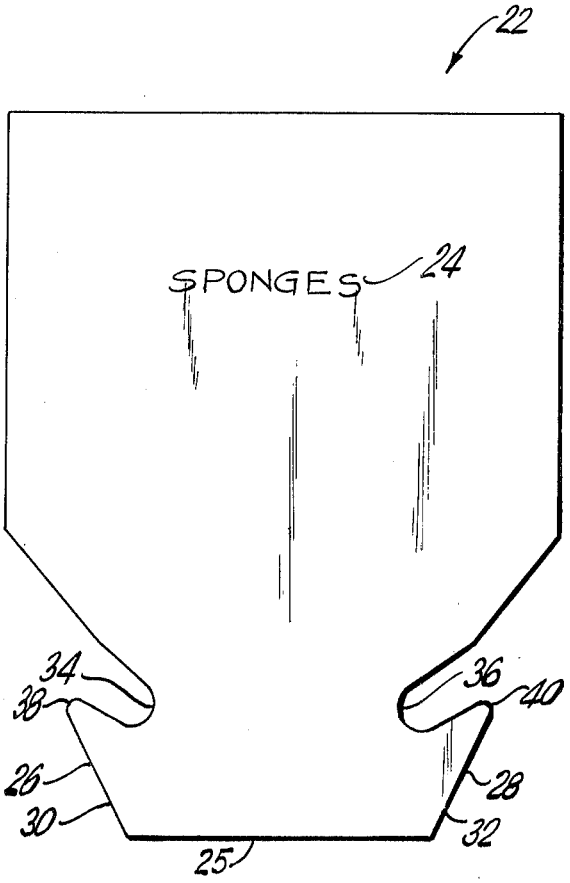
FIG. 2 is an elevation of the header employed in the package of FIG. 1.

The upper end 20 of the package 10 is left opened even after the articles 18 are placed therein, and is then closed by the insertion thereinto of the lower end of a header 22, which is shown separately in FIG. 2, and as included in the package in FIG. 1. The header, which may be formed of cardboard or a plastic material, may contain, as shown at 24, indicia describing and promoting the packaged articles, and also serves as a convenient handle for the package when it is secured to the package.

In contrast with the prior art arrangements, the header 22 is secured to the mesh package 10 without the use of fasteners or adhesive, and also serves to close the upper end of the package.

To this end, as seen best in FIG. 2, the header 22 includes a base 25, and a pair of opposed, upstanding winglike members 26 and 28 defined respectively by tapering wall sections 30 and 32 extending upwardly and outwardly from base 25, and a pair of U-shaped cutouts 34 and 36. The tips 38 and 40 of the wing-shaped members are tapered and are rounded at their ends. The width of the tips are less than the major dimension, e.g. length, of the openings 16 in the mesh package 10, and are of sufficient length such that when the lower end of the header 22 is inserted into the open end of the package, which is facilitated by the camming action of the tapered side walls 30 and 32, the wing members 26 and 28 extend through the mesh openings 16 and thereby retain the header in the upper end of the package.

The rounded tips of the wing members 26 and 28, which project through the mesh openings, prevent injury to the consumer in the event she should contact the ends of these members when she picks up the package. To remove the header from the package to permit access to the interior and permit the removal of the articles, the mesh material is pulled over the rounded tips of the wing members and the header is pulled out of the package. To reclose the package, the header is simply reinserted into the upper open end of the package so that the wing members again project through the mesh openings.

It will, thus, be appreciated that a package has been described which is economical to fabricate and easy for the consumer to open and reclose after an initial use. It will also be appreciated that modifications may be made to the embodiment of the invention hereinabove described without necessarily departing from the spirit and scope of the invention.

What is claimed is:

1. A container for articles including a package having mesh-like openings at at least a portion adjacent its upper end, the lower end of said package being closed, and a header inserted into the upper end of said package, said header comprising an upper portion having a width greater than the width of the upper end of said package, a base, and a pair of opposed tapering camming side walls extending upwardly and outwardly from said base and defining a pair of opposed wing-like members extending from said base, the width of said base being less than the width of the upper opening of said package to permit the insertion of the lower part of said header into said package, the distance between the ends of said wing-like members being less than the width of said upper portion and the ends of said wing-like members having one dimension less than one dimension of said mesh-like openings, such that when the lower end of said header is inserted into the upper end of said package, the ends of said winglike members respectively project through opposed ones of said openings, thereby retaining said header in said package and closing the upper end of said package.

2. The container of claim 1, in which said header further includes a pair of U-shaped cutouts formed therein and defining along with said camming side walls said wing-like members.

3. The container as claimed in claim 1, in which the ends of said winglike member are arcuate in shape.

* * * * *